US008620183B2

(12) United States Patent
Hosoi

(10) Patent No.: US 8,620,183 B2
(45) Date of Patent: Dec. 31, 2013

(54) SHEET CONVEYING APPARATUS AND IMAGE FORMING APPARATUS

(75) Inventor: Shinichiro Hosoi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 321 days.

(21) Appl. No.: 12/576,492

(22) Filed: Oct. 9, 2009

(65) Prior Publication Data

US 2010/0098473 A1 Apr. 22, 2010

(30) Foreign Application Priority Data

Oct. 16, 2008 (JP) ..... 2008-267212

(51) Int. Cl.
*B65H 15/00* (2006.01)

(52) U.S. Cl.
USPC ..... 399/124; 399/21; 399/401

(58) Field of Classification Search
USPC ..... 399/400, 401, 21, 124, 18, 19, 125; 400/691–693; 271/291
See application file for complete search history.

(56) References Cited

U.S. PATENT DOCUMENTS

| | | | | |
|---|---|---|---|---|
| 7,203,448 | B2 * | 4/2007 | Yokoi | 399/124 |
| 2006/0018672 | A1 * | 1/2006 | Asaba | 399/21 |
| 2006/0280533 | A1 * | 12/2006 | Ozawa | 399/361 |
| 2008/0253802 | A1 | 10/2008 | Koyanagi et al. | 399/114 |
| 2009/0162116 | A1 | 6/2009 | Mogi et al. | 399/329 |

FOREIGN PATENT DOCUMENTS

| | | |
|---|---|---|
| JP | H08-202095 A | 8/1996 |
| JP | 2003-167469 | 6/2003 |
| JP | 2007-128005 | 5/2007 |
| JP | 2008-292517 | 12/2008 |

OTHER PUBLICATIONS

Notification of Second Office Action dated Dec. 9, 2011, issued by The State Intellectual Property Office of P.R. China, in Chinese Patent Application No. 200910178171.2., and English translation.

* cited by examiner

*Primary Examiner* — Matthew G Marini
*Assistant Examiner* — Ruben Parco, Jr.
(74) *Attorney, Agent, or Firm* — Fitzpatrick, Cella, Harper & Scinto

(57) ABSTRACT

In a sheet conveying apparatus according to the present invention, a guide unit is rotatably disposed in an apparatus body. The sheet conveying apparatus includes a conveying portion which is disposed in the guide unit in such a manner as to be movable relatively to a cover and conveys the sheet on a second conveyance path, and a positioning portion which is disposed in the cover and positions the conveying portion at the cover when the cover is closed with respect to the apparatus body. The guide unit is moved to a closure position during the operation for closing the cover, and thereafter, the positioning portion positions the conveying portion by the operation for closing the cover.

14 Claims, 12 Drawing Sheets

FIXING CONVEYANCE PATH IS OPEN

NORMAL

REVERSE CONVEYANCE PATH IS OPEN

FIXING CONVEYANCE PATH IS OPEN

FIXING CONVEYANCE PATH IS OPEN

START OF TURN OF DOUBLE-SIDED GUIDE UNIT

CRITICAL POINT OF DOUBLE-SIDED GUIDE UNIT

RETURN OF DOUBLE-SIDED GUIDE UNIT BY ITS SELF WEIGHT

START OF FITTING OF POSITIONING PIN

NORMAL STATE

POSITIONING PIN

PIN HOLE

SHEET CONVEYING APPARATUS AND IMAGE FORMING APPARATUS

BACKGROUND OF THE INVENTION

1. Field of the Invention

The present invention relates to a sheet conveying apparatus which conveys a sheet and an image forming apparatus provided with the same.

2. Description of the Related Art

An image forming apparatus which transfers a toner image while conveying a recording material from below to above through a first conveyance path disposed in parallel to the side surface of a casing and fixes the toner image in a fixing device disposed substantially right above a transferring portion has been put to practical use (Japanese Patent Application Laid-open (JP-A) No. 2007-128005).

In the image forming apparatus disclosed in JP-A No. 2007-128005, a second conveyance path is interposed between the first conveyance path and the side surface of the casing. The recording material having the toner image fixed thereon is switched back to be conveyed from above to below through the second conveyance path, and then, is fed to the transferring portion again.

In the above-described image forming apparatus, a rotatable cover unit is generally disposed in the casing. When the cover unit is opened, the second conveyance path is released. Releasing the second conveyance path is directed to taking out a sheet jammed on the second conveyance path. In addition, a guide unit forming the second conveyance path in cooperation with the cover unit is rotatably disposed in the casing inside of the cover unit. The cover unit is rotated, and then, the guide unit is rotated, so that the first conveyance path for the sheet is released.

In the case where the guide unit is disposed inside of the cover unit, the guide unit should be desirably pushed to a position where the first conveyance path is closed in abutment against the cover unit to be closed in order to prevent forgetting to close the guide unit.

In JP-A Nos. 2003-167469 and 2008-292517 has been proposed a configuration in which a jammed sheet is removed, and then, a guide unit is automatically moved to a position where a conveyance path is closed in mechanical association with a cover unit to be closed.

Here, the cover unit and the guide unit are disposed with a slight play with respect to the casing. As a consequence, a relative position between a second roller disposed in the cover unit and a first roller disposed in the guide unit is shifted by the play. When the sheet is conveyed by the second roller and the first roller while being nipped therebetween, the sheet is skew fed or is shifted widthwise onto either side, therefore, the precision of the conveying the sheet is not high. As the precision of the conveying the sheet is not high, an obverse image and a reverse image are deviated from each other.

In order to solve such a problem, it may be construed that the cover unit and the guide unit are fixed to a common frame by the use of precise bearings without any play. However, in such a case, the second roller need be precisely fixed to the cover unit, and further, the first roller need be precisely fixed to the guide unit, thereby increasing cost.

The present invention provides a sheet conveying apparatus which can convey the sheet with the high precision.

SUMMARY OF THE INVENTION

A sheet conveying apparatus according to an aspect of the present invention includes: an apparatus body; a guide unit which is supported by the apparatus body in such a manner as to be rotated between a closure position and an open position and forms a first conveyance path, on which a sheet is conveyed, in cooperation with the apparatus body; a cover which is rotatably supported by the apparatus body and forms a second conveyance path, on which the sheet is conveyed, in cooperation with the guide unit; a engaging portion which is provided in the cover to engage with the guide unit, and the engaging portion pushing the guide unit located at the open position toward the closure position by an operation for closing the cover with respect to the apparatus body; a conveying portion which is disposed in the guide unit in such a manner as to be movable relatively to the cover and conveys the sheet on the second conveyance path; and a positioning portion which is disposed in the cover and positions the conveying portion with respect to the cover when the cover is closed with respect to the apparatus body, wherein the guide unit is moved to the closure position during the operation for closing the cover, and thereafter, the positioning portion positions the conveying portion by the operation for closing the cover.

The sheet conveying apparatus according to another aspect of the present invention can suppress the recording material from being skew fed or shifted widthwise onto either side when the conveying portion is positioned by the positioning portion.

Further features of the present invention will become apparent from the following description of exemplary embodiments with reference to the attached drawings.

DESCRIPTION OF THE EMBODIMENTS

A detailed description will be given below of an embodiment according to the present invention with reference to the attached drawings. The present invention can be implemented in other embodiments in which part or all of constituent elements in the embodiment are replaced with alternative elements as long as a first roller and a second roller are positioned in parallel to each other in association with operation for closing a cover unit.

Although an image forming apparatus using an intermediate transfer belt is described in the present embodiment, the present invention can be implemented in an image forming apparatus using a recording material conveyance belt or an image forming apparatus which directly transfers a toner image from a photosensitive drum onto a recording material (i.e., a sheet).

<Image Forming Apparatus>

Figure 1:
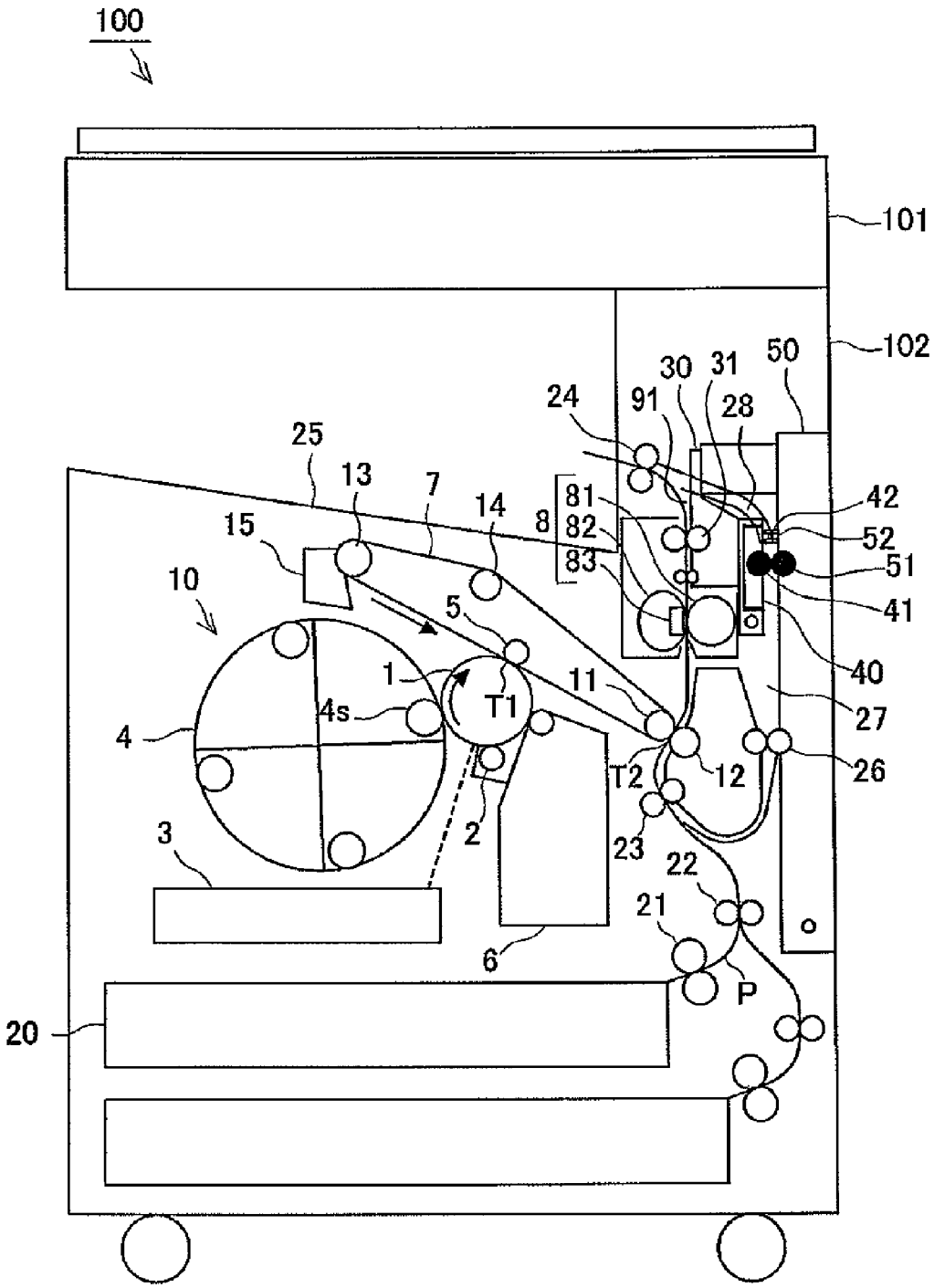
FIG. 1 is a view illustrating the configuration of an image forming apparatus in a first embodiment.

FIG. 1 is a view illustrating the configuration of an image forming apparatus in a first embodiment.

As illustrated in FIG. 1, an image reader (i.e., a flat bed scanner) 101 is disposed above an apparatus body 102 having an image forming unit 10 mounted thereon in an image forming apparatus 100. An inside discharge space is secured between the apparatus body 102 and the image reader 101, and a discharge tray 25 is disposed in the space.

The image forming unit 10 forms a toner image on a photosensitive drum 1, and then, primarily transfers the image onto an intermediate transfer belt 7 at a primary transfer portion T1. The toner image primarily transferred onto the intermediate transfer belt 7 is secondarily transferred onto a sheet P fed to a secondary transfer portion T2. The sheet P having the toner image secondarily transferred thereonto is fed to a fixing device 8 disposed right above the secondary transfer portion T2, and then, is subjected to fixing with the toner image.

The image forming unit 10 includes a charging roller 2, an exposing device 3, a rotary development device 4, a primary transfer roller 5, and a cleaning device 6 arranged around the rotating photosensitive drum 1. The charging roller 2 electrically charges the photosensitive drum 1 to a dark potential VD of a uniformly negative polarity. The exposing device 3 scans the charged photosensitive drum 1 with a laser beam, to decrease its potential down to a light potential VL, thereby writing an electrostatic image on the photosensitive drum 1.

The rotary development device 4 allows developers for yellow, magenta, cyan, and black colors to be moved to a development position in sequence, and thus, develops the electrostatic image formed on the photosensitive drum 1 with color toners. The rotary development device 4 allows the toner charged to the negative polarity to selectively adhere to a portion having the light potential VL, thereby reversely developing the electrostatic image.

The intermediate transfer belt 7 is stretched across and supported on a drive roller (i.e., a counter roller) 11, a tension roller 13, a stretch roller 14, and the primary transfer roller 5, to be rotated in a direction indicated by an arrow. The toner image carried on the photosensitive drum 1 is primarily transferred onto the intermediate transfer belt 7 by applying a DC voltage of a positive polarity to the primary transfer roller 5. The toner images of yellow, magenta, cyan, and black colors are primarily transferred in sequential superimposition onto the intermediate transfer belt 7 while the secondary transfer portion T2 and a belt cleaner 15 are separated.

The sheets P are taken from a cassette 20, to be separated one by one by a pair of separation rollers 21, are conveyed from a pair of conveyance rollers 22 to a pair of registration rollers 23, and then, wait for a printing operation. The toner images carried on the intermediate transfer belt 7 are secondarily transferred onto the sheet P by applying a DC voltage of a positive polarity to the secondary transfer roller 12. The toner images of the four colors carried on the intermediate transfer belt 7 are secondarily transferred at one time onto the sheet P fed to the secondary transfer portion T2 by the registration rollers 23 while providing timing of the primary transfer of the toner image of the final color.

<First Conveyance Path and Second Conveyance Path>

Figure 2A:
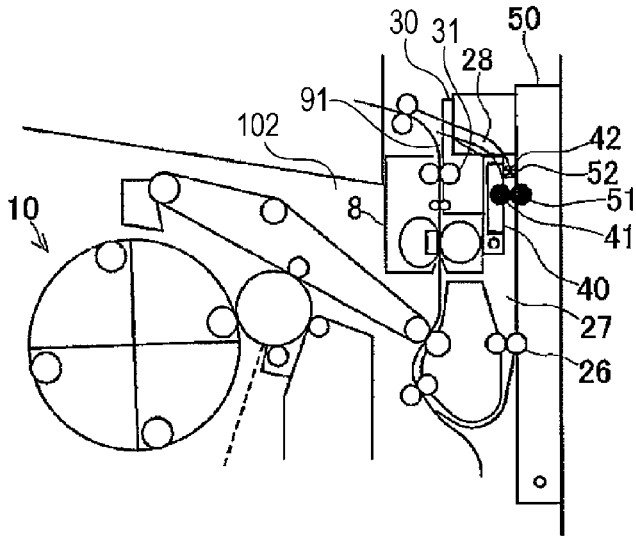
FIGS. 2A to 2C are views illustrating procedures for releasing first and second conveyance paths.
Figure 2B:
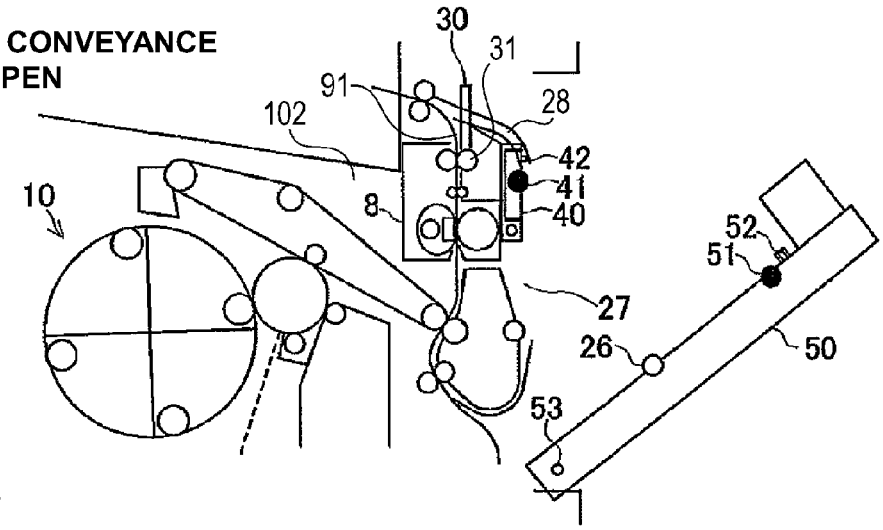
Figure 2C:
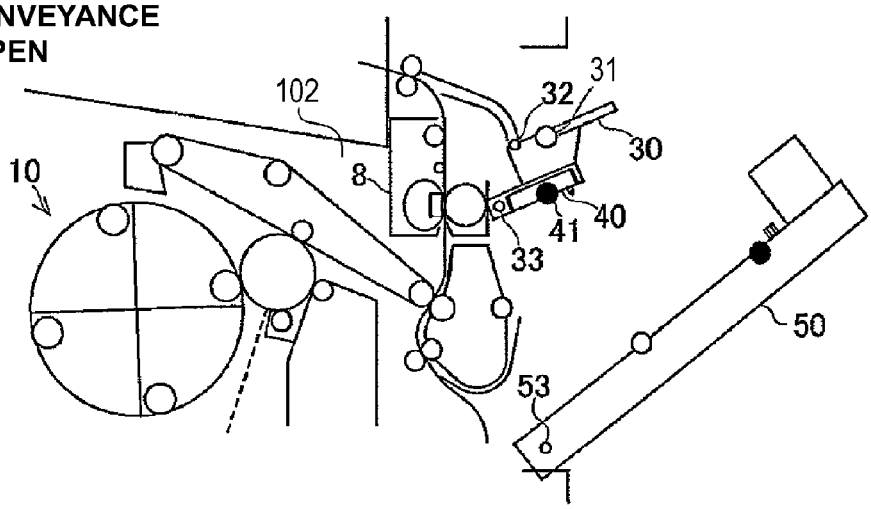

FIGS. 2A to 2C are views illustrating procedures for releasing the first and second conveyance paths. FIGS. 3A to 3F are views illustrating procedures for closing the first and second conveyance paths so as to return them to their normal states.

In a single-sided printing mode, the sheet P, which is taken from the cassette 20, has the toner images transferred thereonto at the secondary transfer portion T2, and is subjected to the fixing operation by the fixing device 8, passes through a conveyance path 91 after fixing as a first conveyance path, and then, reaches a pair of discharge rollers 24. Thereafter, the sheet P is discharged onto the discharge tray 25 by the discharge rollers 24.

In contrast, in a duplex printing mode, the sheet P having the toner images transferred thereonto and fixed thereto is switched back by the discharge rollers 24, and then, is fed to reverse paths (i.e., second conveyance paths) 28 and 27. The sheet P is conveyed through the reverse paths 28 and 27 in a reversal state, and then, waits for a printing operation between the registration rollers 23. The sheet P is fed to the secondary transfer portion T2 by the registration rollers 23 at a timing when the toner images of the four colors are carried on the intermediate transfer belt 7. The sheet P having the toner images of the four colors secondarily transferred also at the reverse thereof at one time through the secondary transfer portion T2 is fixed by the fixing device 8, and then, reaches the discharge rollers 24 through the conveyance path 91 after fixing. Thereafter, the sheet P is discharged onto the discharge tray 25 by the discharge rollers 24.

A jammed sheet is removed from the conveyance path 91 after fixing as the first conveyance path and the reverse paths 27 and 28 as the second conveyance path by opening the conveyance path 91 after fixing and the reverse paths 27 and 28 in accordance with the procedures illustrated in FIGS. 2A to 2C.

As illustrated in FIG. 2A, a pair of conveyance rollers 31 after fixing on the conveyance path 91 after fixing forms a nip by closing a double-sided guide unit 30 serving as a fixing cover in the fixing device 8 in a normal state. On the other hand, a pair of conveyance rollers 41 and 51 forms a nip by closing a cover unit 50 on the reverse paths 28 and 27. One side of the double-sided guide unit 30 and the apparatus body 102 form the conveyance path 91 after fixing serving as the first conveyance path. On the other hand, a roller supporting block 40 serving as a conveyance portion fixed onto the other side of the releasable double-sided guide unit 30 and the inside of the releasable cover unit 50 form the reverse paths 28 and 27 as the second conveyance path.

The roller supporting block (i.e., a first roller supporting member) 40 is fixed in such a manner as to be slightly rotated and moved (freely inclined) within a plane of the second conveyance path with respect to the double-sided guide unit 30, thereby supporting a rotary shaft of the conveyance roller 41 (i.e., arranging a first roller). As a consequence, the roller supporting block 40 is disposed in the double-sided guide unit 30 in such a manner as to be movable relatively to the cover unit 50. The cover unit 50 supports a rotary shaft of the conveyance roller 51. The cover unit 50 has a couple of pin holes 52 in separation in a direction perpendicular to the drawing sheet. On the other hand, the roller supporting block 40 has a couple of positioning pins 42 to be fitted into the couple of pin holes 52, respectively. As described later, the roller supporting block 40 is moved and fixed (i.e., positioned) with respect to the cover unit 50 such that the conveyance roller 41 and the conveyance roller 51 become parallel to each other when the positioning pin 42 is restrained by the pin hole 52. Conversely, as shown in FIGS. 10C and 10D, pins 42A may be provided to the cover unit 50 whereas pin holes 52A may be formed at the roller supporting block 40.

As illustrated in FIG. 2B, when the cover unit 50 is rotated outward on a hinge pin 53, the reverse path 27 is released, and then, the nip formed between the conveyance rollers 41 and 51 is eliminated. Consequently, a hand is inserted from the outside of the casing, to take out the jammed sheet on the reverse path 27.

As illustrated in FIG. 2C, when the double-sided guide unit 30 is rotated outward on a hinge pin 33, the fixing device 8 is released, so that the nip formed between the conveyance rollers inside of the fixing device 8 is eliminated. Consequently, a hand can be inserted from the outside of the casing, to take out the jammed sheet in the fixing device 8.

By closing the first conveyance path and the second conveyance path in accordance with the procedures illustrated in FIGS. 3A to 3F, the first conveyance path and the second conveyance path are returned to the normal states after the jammed sheet is taken out.

Figure 3A:
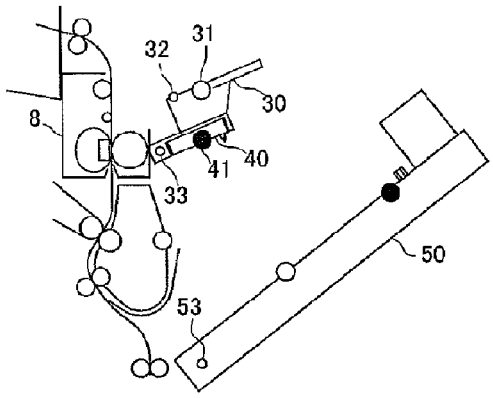
FIGS. 3A to 3F are views illustrating procedures for closing the first and second conveyance paths so as to return them to their normal states.

As illustrated in FIG. 3A, the jammed sheet is removed when the fixing device 8 is released. It is visually detected whether or not a broken piece of the jammed sheet remains inside of the casing or other abnormalities occur. After the double-sided guide unit 30 is closed in this state, the cover unit 50 may be closed. However, in order to prevent forgetting to close the double-sided guide unit 30, even if the cover unit 50 is closed while the double-sided guide unit 30 is open, the double-sided guide unit 30 is automatically closed in association with the operation for closing the cover unit 50.

Figure 3B:
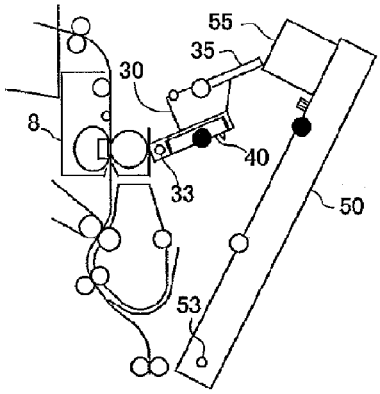

As illustrated in FIG. 3B, when the cover unit 50 is raised, a pushing plate 55 serving as an engaging portion for the cover unit 50 exemplifying an abutting structure abuts against a receiving portion 35 of the double-sided guide unit 30, thereby turning the double-sided guide unit 30 in a closure direction.

Figure 3C:
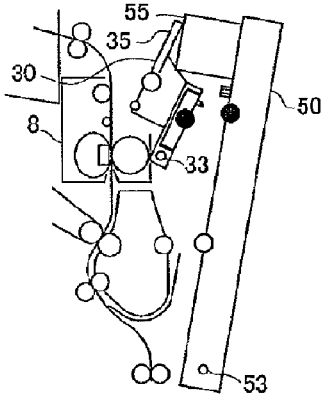

As illustrated in FIG. 3C, when the barycenter of the double-sided guide unit 30 goes beyond the normal of the hinge pin 33, the double-sided guide unit 30 is rotated in the closure direction by its self weight.

Figure 3D:
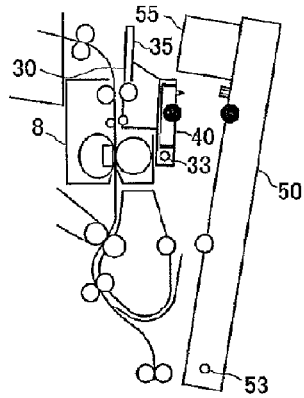

As illustrated in FIG. 3D, the double-sided guide unit 30 returns by its self weight to the position immediately before the nip for the conveyance roller 31 inside of the fixing device 8 is formed, and then, waits for the cover unit 50 which comes to a final process.

Figure 3E:
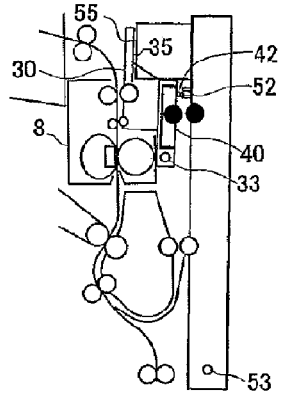
Figure 3F:
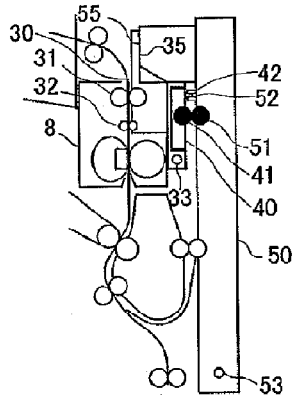

The final process is performed after the tip of the positioning pin 42 reaches the inlet of the pin hole 52 in a positioning portion, as illustrated in FIG. 3E, till the completion of the insertion, as illustrated in FIG. 3F. The pair of positioning pins 42 is restrained in the pair of pin holes 52, respectively. The double-sided guide unit 30 is temporarily separated from the cover unit 50 to be closed, to be rotated in such a manner as to close the first conveyance path, so that the positioning structures 42 and 52 cannot be fitted to each other until the final process is started.

The positioning pin 42 is tapered from the base toward the tip, so that the movable amount of the roller supporting block 40 is decreased within the plane of the second conveyance path as the positioning pin 42 is fitted into the pin hole 52. The positioning pin 42 is moved while being restrained at the edge of the pin hole 52, and consequently, the roller supporting block 40 having the positioning pin 42 formed thereat is rotated within the plane of the second conveyance path.

As illustrated in FIG. 3F, when the positioning pin 42 is fitted into the pin hole 52 without any clearance, the final process is completed. While the positioning pin 42 is fitted into the pin hole 52 without any clearance, the roller supporting block 40 is rotated and moved with respect to the cover unit 50 so as to secure the positional relationship, such that the conveyance roller 41 and the conveyance roller 51 become parallel to each other.

At this time, the pushing plate 55 of the cover unit 50 is actually separated from the receiving portion 35 of the double-sided guide unit 30, and therefore, the nipping force generated between the conveyance roller 41 and the conveyance roller 51 presses the roller supporting block 40 against the double-sided guide unit 30. Furthermore, the nipping force generated between the conveyance roller 41 and the conveyance roller 51 presses the double-sided guide unit 30 against the fixing device 8, and then, acts on the conveyance rollers 32 and 31 for conveying the fixed sheet downstream.

In this manner, the conveyance roller 41 is fixed to the movable roller supporting block 40, and further, the conveyance roller 41 and the conveyance roller 51 are positioned in parallel to each other as the positioning pin 42 is fitted into the pin hole 52. As a consequence, when the cover unit 50 is closed, the excellent positional accuracy between the conveyance roller 41 and the conveyance roller 51 and the association of the double-sided guide unit 30 can be achieved at the same time. In order to achieve the positional accuracy between the conveyance roller 41 and the conveyance roller 51, the double-sided guide unit 30 need not be manually closed before the cover unit 50 is closed. Even with the configuration in which both of the double-sided guide unit 30 and the cover unit 50 are rotatably supported by the apparatus body 102, the positional accuracy between the conveyance roller 41 and the conveyance roller 51 can be secured owing to the fitting of the positioning pin 42 into the pin hole 52.

<Double-Sided Guide Unit>

Figure 4:
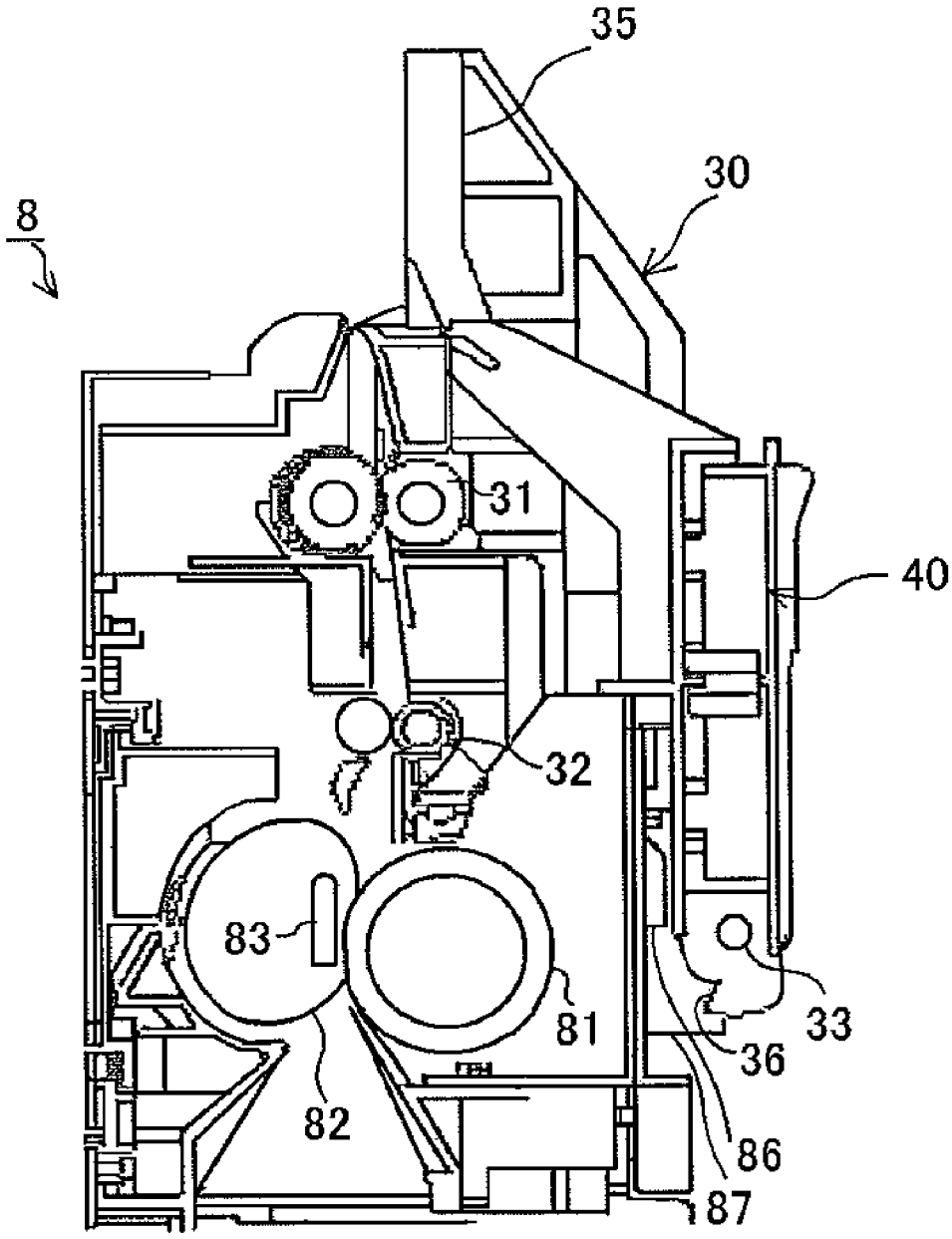
FIG. 4 is a view illustrating a double-sided guide unit in a closed state.
Figure 5:
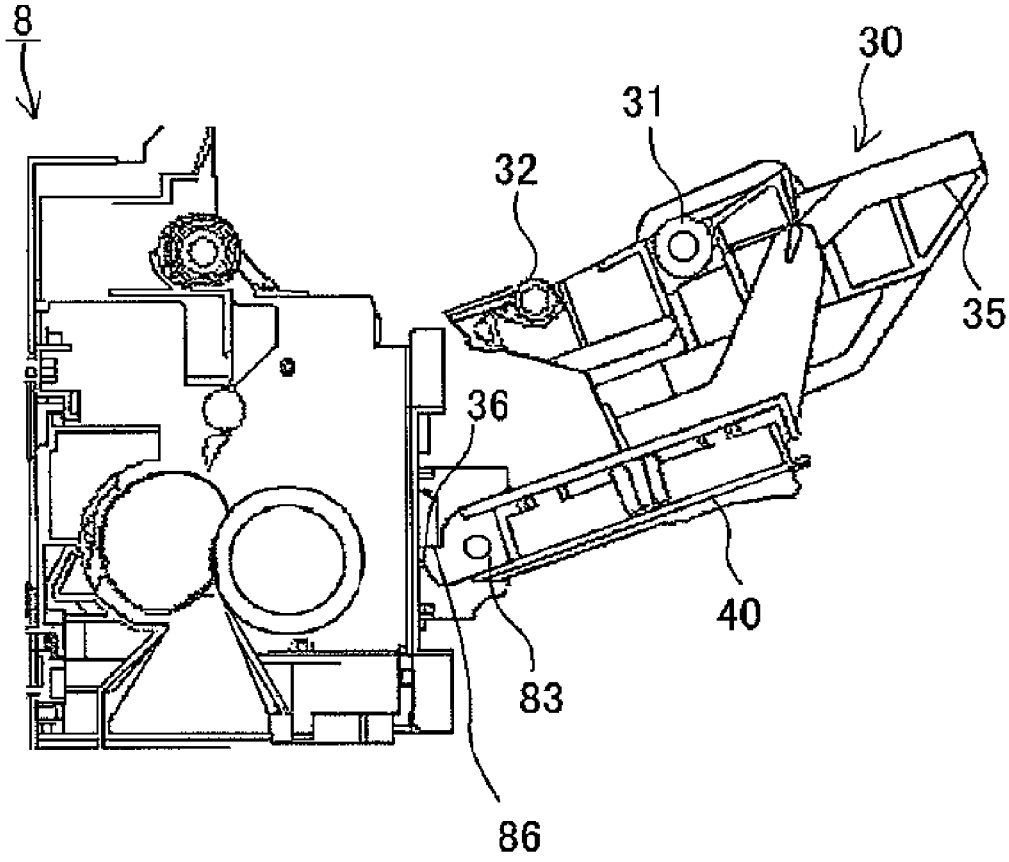
FIG. 5 is a view illustrating the double-sided guide unit in an open state.
Figure 6:
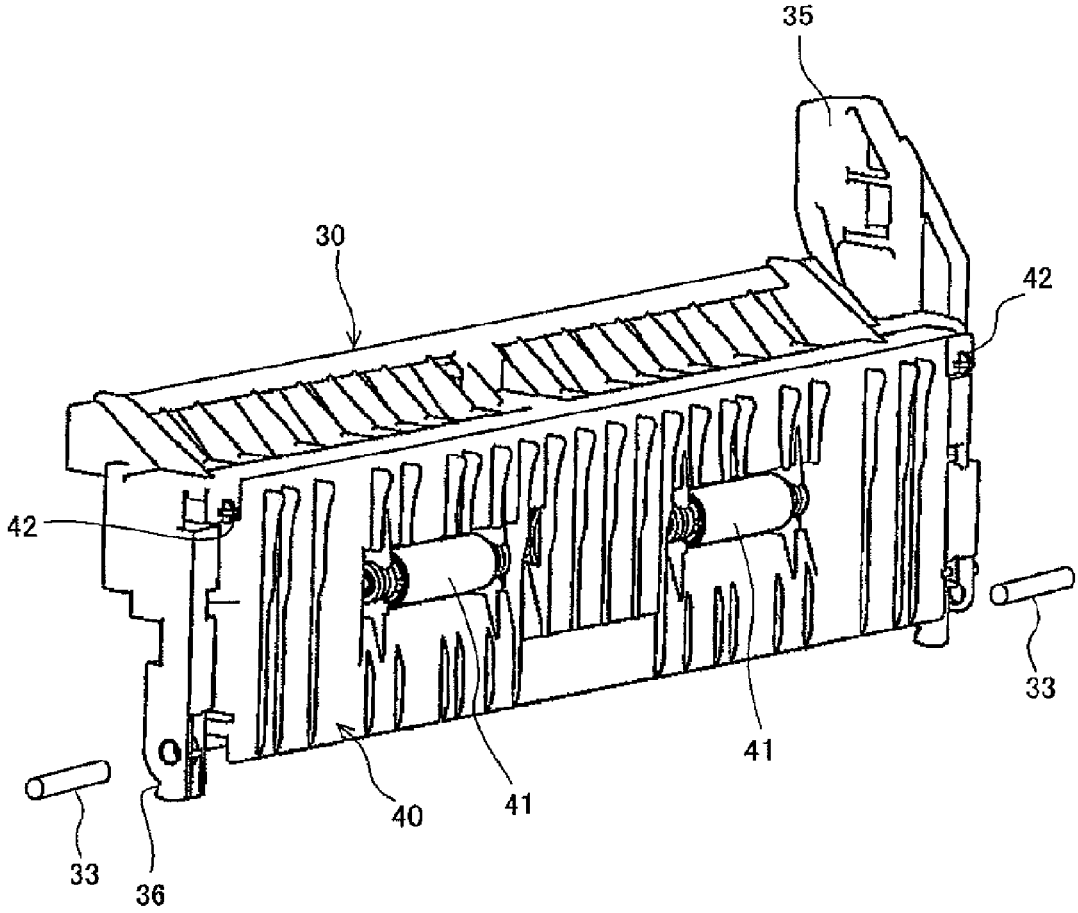
FIG. 6 is a perspective view illustrating the double-sided guide unit.
Figure 7:
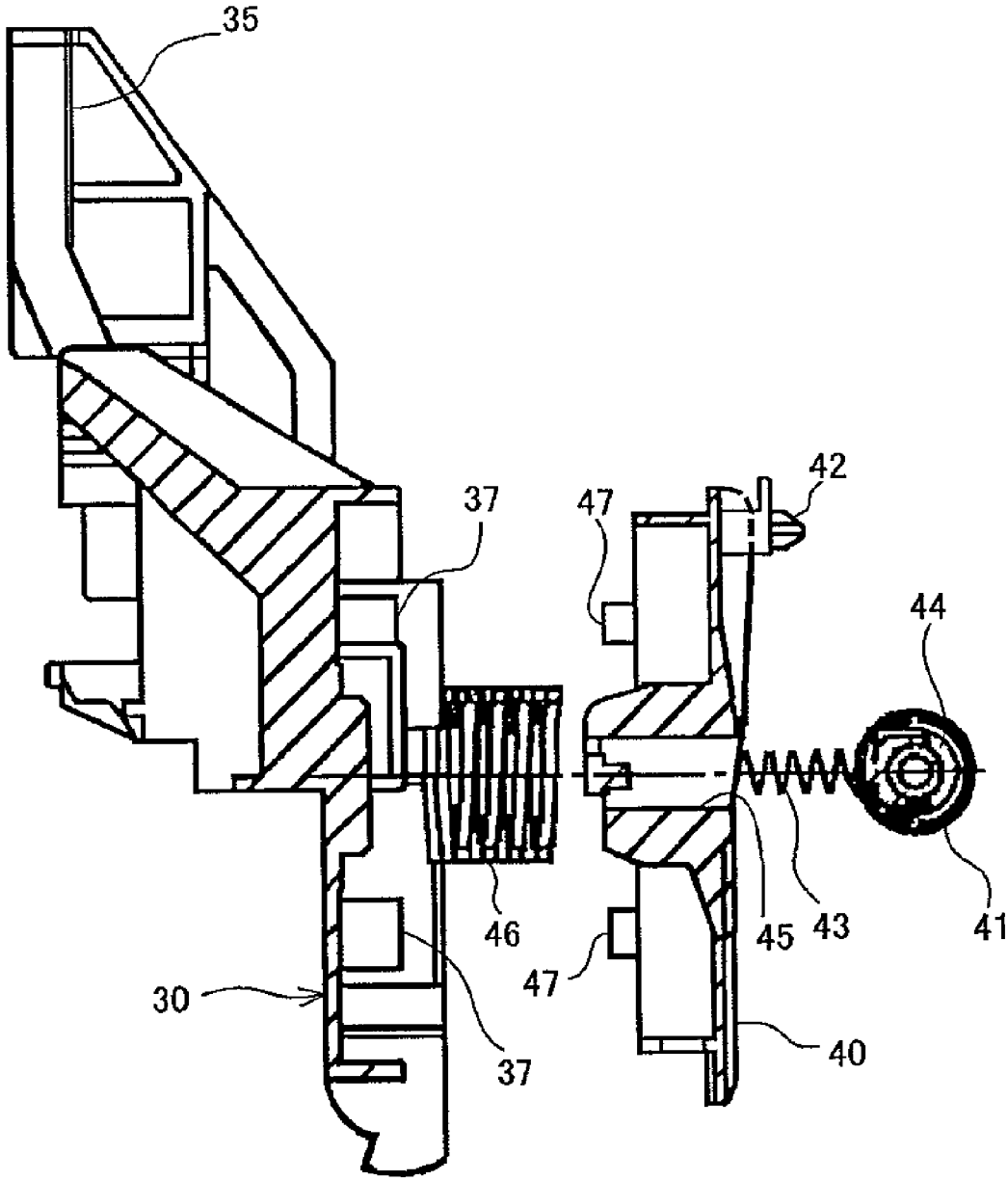
FIG. 7 is a view illustrating a structure for fixing a roller supporting block.

FIG. 4 is a view illustrating the double-sided guide unit in a closed state; FIG. 5 is a view illustrating the double-sided guide unit in an open state; FIG. 6 is a perspective view illustrating the double-sided guide unit; and FIG. 7 is a view illustrating a structure for fixing the roller supporting block.

As illustrated in FIG. 4, in the fixing device 8, a pressure roller 81 is brought into press-contact with a fixing film 82 which is supported from inside by a ceramic heater 83, thereby forming a fixing nip, through which the sheet having the toner image transferred thereonto is nipped and conveyed.

When the double-sided guide unit 30 is closed with respect to the apparatus body 102, nips are formed between the pairs of conveyance rollers 32 and 31 arranged downstream of the fixing nip (i.e., the nip between the fixing film 82 and the pressure roller 81), and further, the conveyance path 91 after fixing (i.e., the first conveyance path) is defined.

The double-sided guide unit 30 is rotatably fixed to a supporter 87 of the fixing device 8 via the hinge pin 33. The maximum open angle of the double-sided guide unit 30 is restricted by allowing a turn restrictor 86 to abut against a restricted surface 36. The double-sided guide unit 30 contacts with the turn restrictor 86 at the restricted surface 36, and the double-sided guide unit 30 is held by the turn restrictor 86 serving as a holder at an open position of the double-sided guide unit 30 whose turn is restricted at the turn restrictor 86. The double-sided guide unit 30 is held in a state released from the fixing device 8 by the turn restrictor 86 and the restricted surface 36, and therefore, the jammed sheet can be readily removed by either hand.

As illustrated in FIG. 5, the maximum open angle of the double-sided guide unit 30 is set to about 70° such that the receiving portion 35 abuts against the pushing plate 55 of the cover unit 50 at a position at which the double-sided guide unit 30 is rotated at the maximum open angle (see FIG. 3B).

As illustrated in FIG. 6, the receiving portion 35 is disposed in such a manner as to project outside in a direction of a sheet conveyance width of the double-sided guide unit 30 having a guide rib on the second conveyance path formed thereover. As described with reference to FIGS. 3A to 3F, the double-sided guide unit 30 is rotated by the abutting structure of the receiving portion 35 until the double-sided guide unit 30 is started to be rotated by its self weight. In the present embodiment, no pressure is applied to the receiving portion 35 when the double-sided guide unit 30 is closed.

The pair of conveyance rollers 41 (on a driven side) is arranged at the center of the roller supporting block 40, and further, the positioning pins 42 are fixed at both ends of the roller supporting block 40. A setting accuracy of an inclination of the conveyance roller 41 with respect to the positional accuracy of the formation of the positioning pin 42 is enhanced by securing a great distance between the pair of positioning pins 42.

As illustrated in FIG. 7, the conveyance rollers 41 are rotatably supported by bearings 44 disposed at both ends, respectively. The bearing 44 can be moved in a projection direction along a guide groove 45 formed in the roller supporting block 40. The bearing 44 can project from the roller supporting block 40 via a spring 43. The bearing 44 is sunk during the processes illustrated in FIGS. 3E and 3F while compressing the spring 43, thereby applying the nipping force to the conveyance roller 41.

The roller supporting block 40 is supported by the double-sided guide unit 30 via a spring 46, and further, the roller supporting block 40 can be rotated and moved within the plane of the second conveyance path within a range of a play formed at an inserted portion 47 inside of a guide recess 37. The spring 46 serving as a biasing member is resiliently interposed between the roller supporting block 40 and the double-sided guide unit 30. As a consequence, the roller supporting block 40 is resiliently biased against the cover unit 50 all the time.

The pushing amount of the cover unit 50 after the roller supporting block 40 is brought into press-contact with the double-sided guide unit 30 is absorbed by the compression of the spring 43. Consequently, a great stress cannot be exerted on the cover unit 50, the roller supporting block 40, and the double-sided guide unit 30, thus preventing any shift of the nip between the conveyance rollers 41 and 51, any change in pressure distribution, or any curl of the roller supporting block 40. The conveyance rollers 41 and 51 can be kept properly pressurized via the spring 43, thus maintaining the smooth sheet conveyance on the second conveyance path.

<Cover Unit>

Figure 8:
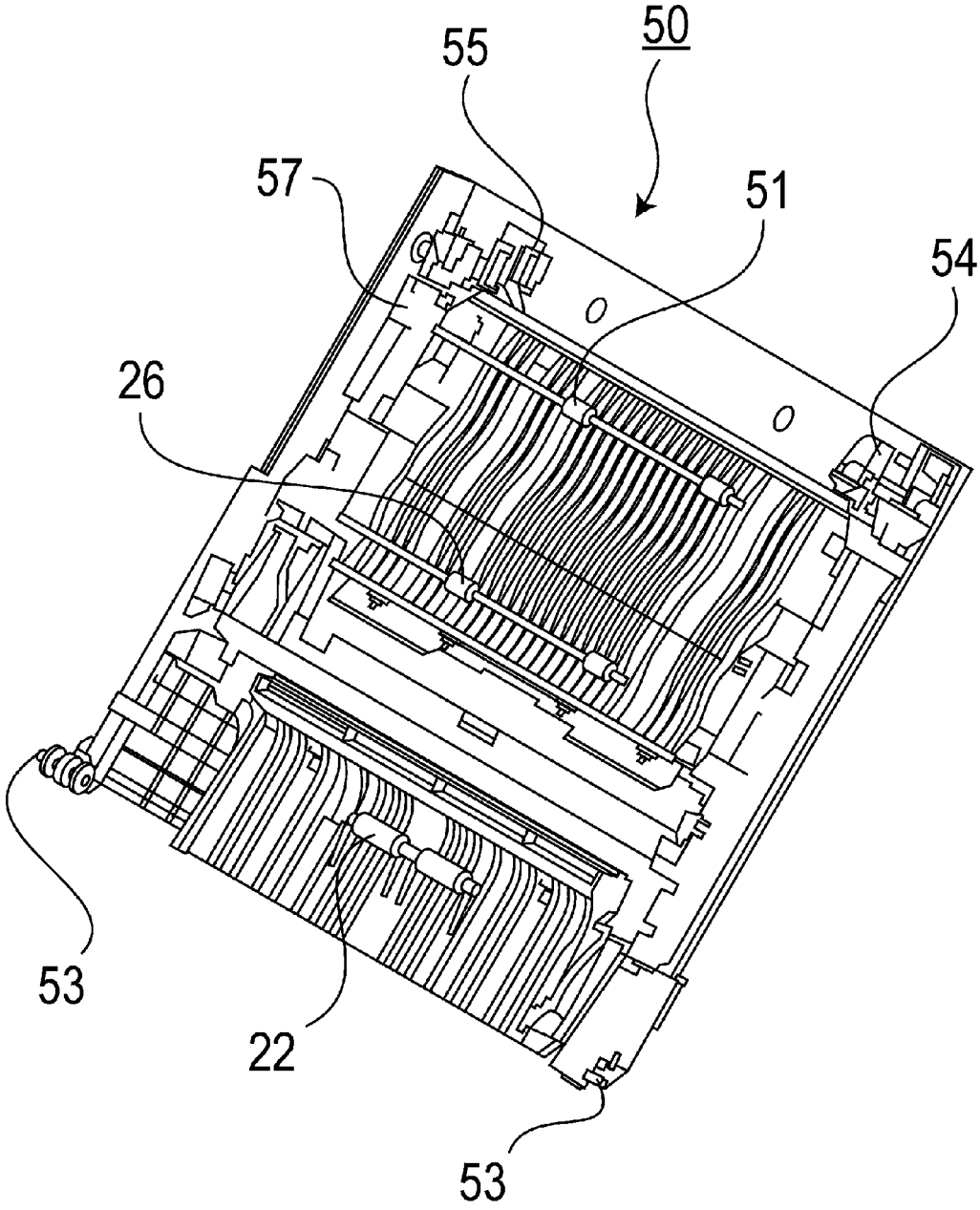
FIG. 8 is a perspective view illustrating a cover unit.
Figure 9:
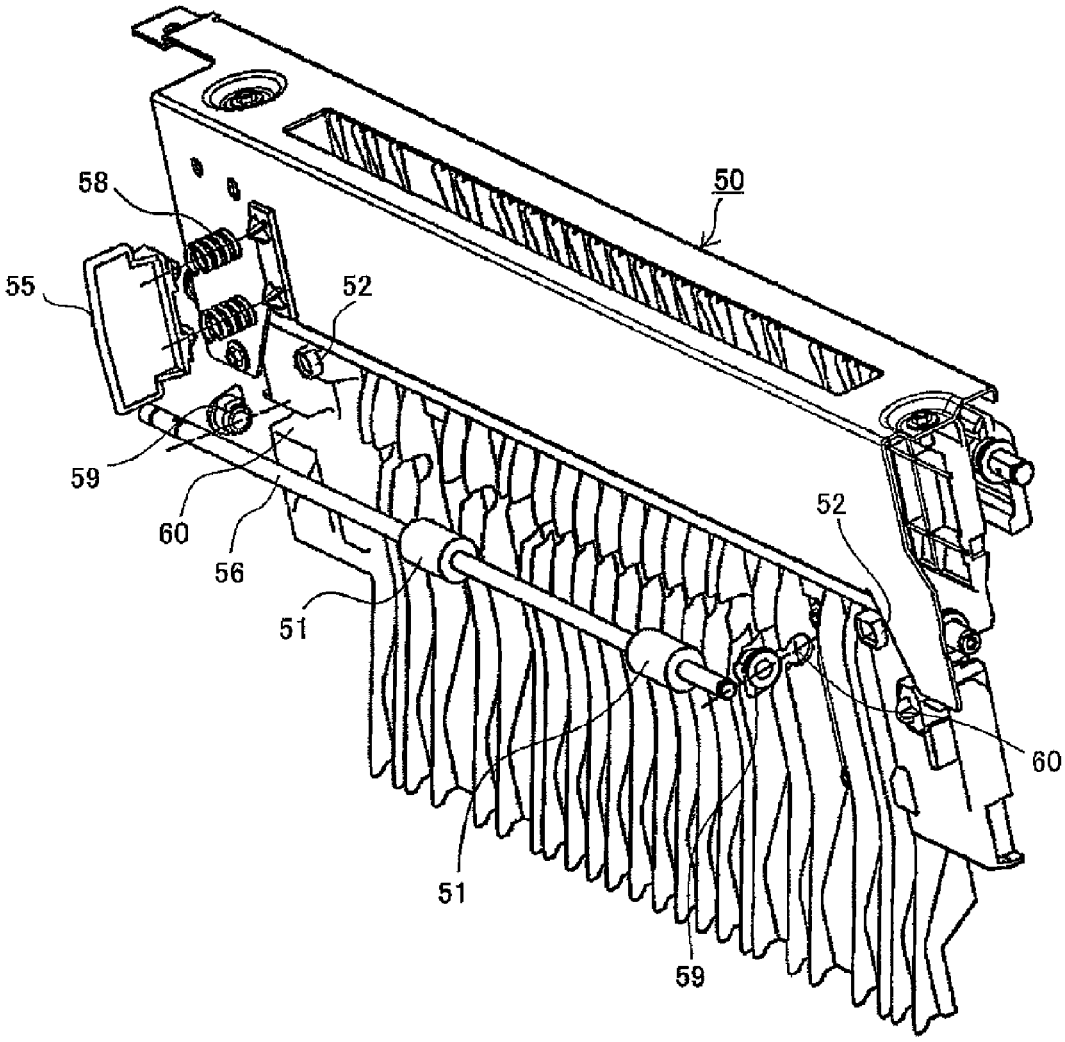
FIG. 9 is a view illustrating a structure for fixing a pushing plate for the cover unit.

FIG. 8 is a perspective view illustrating the cover unit; and FIG. 9 is a view illustrating a structure for fixing the pushing plate for the cover unit.

As illustrated in FIG. 8, the cover unit 50 is rotatably fixed in a height direction via the hinge pin 53 at the lower portion of the apparatus body (102 in FIG. 1). The cover unit 50 having a guide rib on the second conveyance path formed over the entire inside surface is rotated on the hinge pin 53 so as to release the side surface of the casing.

At the upper portion of the cover unit 50, there are provided a lock mechanism 54 for closing a casing structure and the pushing plate 55 for pushing the double-sided guide unit 30 in abutment against the receiving portion 35 illustrated in FIG. 6. The pushing plate 55 is fixed to the cover unit 50 via a spring 58.

After the removal of the jammed sheet, the cover unit 50 is rotated in a raising direction, to be gradually housed inside of the apparatus body (102 in FIG. 1). On the way, the pushing plate 55 abuts against the receiving portion 35 of the double-sided guide unit 30 illustrated in FIG. 6. The abutment of the pushing plate 55 against the receiving portion 35 allows the double-sided guide unit 30 to be fitted to the cover unit 50 on the back of the apparatus body, thereby closing the double-sided guide unit 30 in association with the cover unit 50.

After the double-sided guide unit 30 is returned by its self weight, the pushing plate 55 and the receiving portion 35 are fitted to each other again. Here, the pushing plate 55 is retreated by the spring 58, and therefore, the positioning state and the pressurized state between the conveyance roller 41 and the conveyance roller 51 cannot be influenced.

In the cover unit 50 are disposed the conveyance rollers (on a drive side) 51 and 26 for conveying the sheet on the second conveyance path. There conveyance rollers 51 and 26 are driven by a mechanism housed inside of a driving unit 57.

As illustrated in FIG. 9, a bearing 59 for rotatably supporting the conveyance roller 51 is press-fitted into a fixing hole 60 formed at the guide rib in assembling. The conveyance roller 51 is pivotably supported by the bearing 59. In particular, the bearing 59 made of metal is fitted into the fixing hole 60 which is formed by hollowing the guide rib, and then, a shaft 56 of the conveyance roller 51 is fitted into the axial hole of the bearing 59.

<Positioning Structure>

Figure 10A:
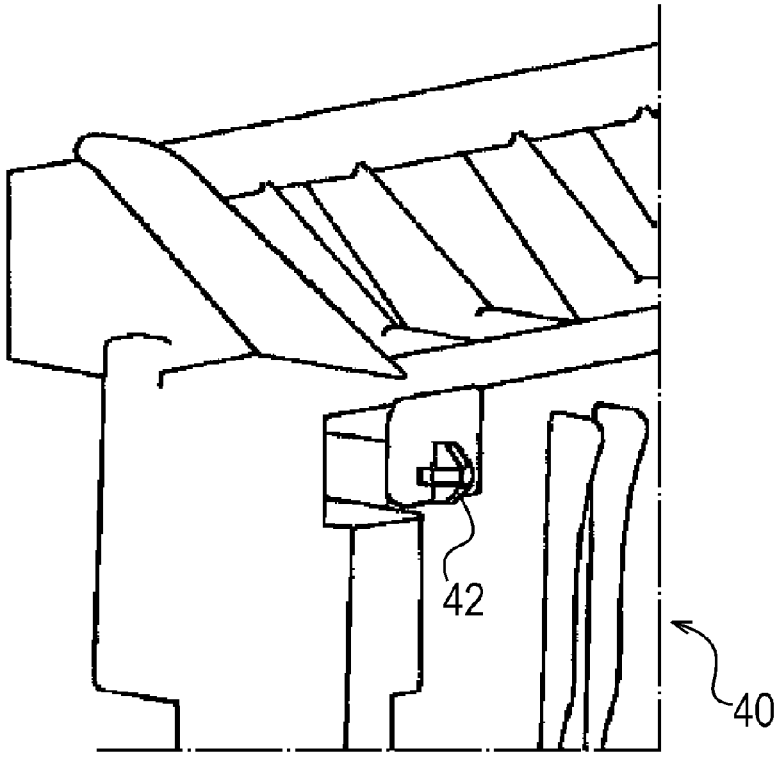
FIGS. 10A to 10D are enlarged views illustrating a positioning structure.
Figure 10B:
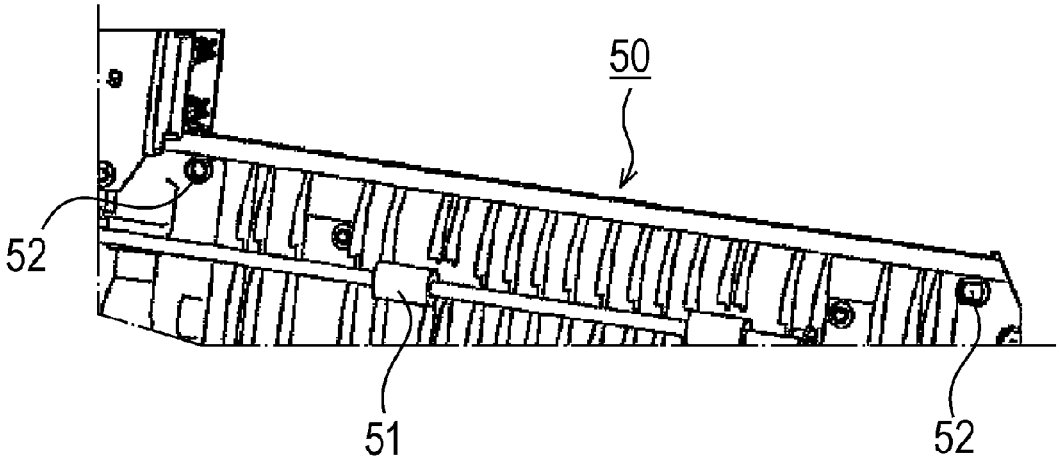
Figure 10C:
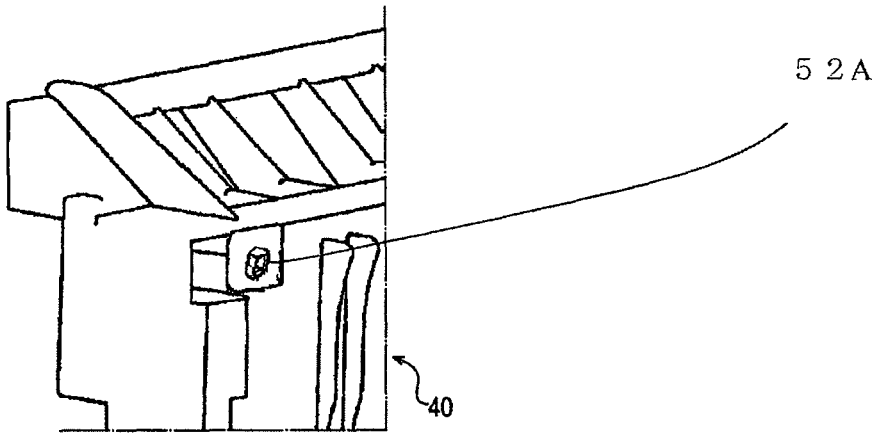
Figure 10D:
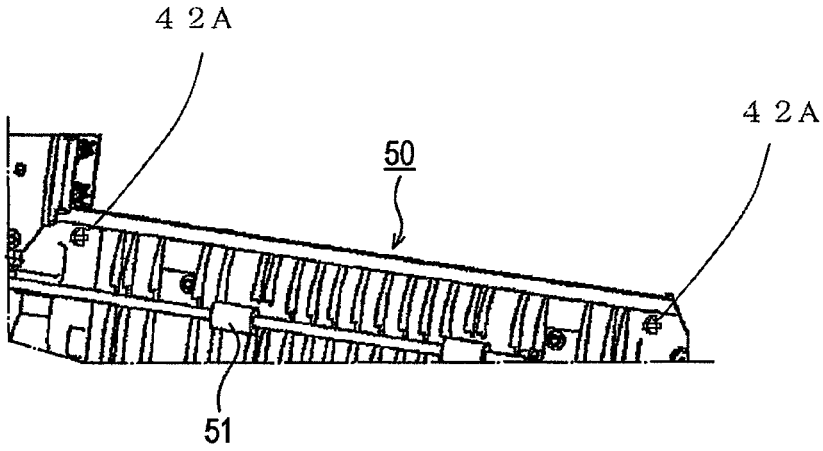

FIGS. 10A and 10B are enlarged views illustrating a positioning structure, wherein FIG. 10A illustrates the positioning pin and FIG. 10B illustrates the pin hole.

As illustrated in FIG. 10A, the positioning pins 42 are molded at both ends in the conveyance width direction of the roller supporting block 40. Each of the positioning pins 42 is formed into a cross shape on the plane in an insertion direction, the cross having a taper at each of ribs in the insertion direction. As a consequence, when the positioning pin 42 is fitted into the pin hole 52 illustrated in FIG. 10B, a movable space of the positioning pin inside of the pin hole 52 is reduced as the positioning pin 42 is gradually fitted into the pin hole 52. Thus, the pair of positioning structures is disposed with an interval formed in the axial direction of the first roller. The positioning structures are started to engage with each other during the final process in which the cover unit is closed, and then, the movable amount is reduced within the plane as the engagement gradually proceeds.

As illustrated in FIG. 10B, the pin holes 52 are formed at the same height at both ends in the conveyance width direction of the cover unit 50. One of the pin holes is formed into a cylindrical shape whereas the other pin hole is formed into an elliptically cylindrical shape, thereby absorbing a molding error in the conveyance width direction. Since the pin hole 52 on the back of the apparatus body is formed into a circular shape whereas the pin hole 52 forward is formed into an elliptically circular shape, a stress cannot be exerted on the roller supporting block 40, unlike positioning at a plurality of points.

The roller supporting block 40 is supported by loosely inserting the positioning pins 42 formed at both ends of the roller supporting block 40 into the pin holes 52 formed at both ends of the cover unit 50. As a consequence, the roller supporting block 40 is allowed to be displaced laterally and vertically within the restriction range of the pin holes 52. The roller supporting block 40 is allowed to be displaced laterally and vertically within the restriction range of the pin holes 52, so that the conveyance roller 41 and the conveyance roller 51 are properly positioned in parallel to each other with high accuracy even if there is a slight tolerance at a position of the hinge pin 53 in the cover unit 50.

The roller supporting block 40 is vertically positioned by both of the pin holes 52 whereas it is horizontally positioned by the circular pin hole 52. If both of the pin holes 52 were circular, the positioning pins could not have been completely pushed into the pin holes 52 during the final process unless the pin holes need be formed with the same considerably high positional accuracy of an interval between the pin holes as that between the pair of positioning pins 41, and thus, the roller supporting block 40 cannot be laterally positioned.

Incidentally, when the cover unit 50 is closed at the position illustrated in FIG. 3C, the double-sided guide unit 30 is automatically rotated in the closure direction by its self weight, as illustrated in FIG. 3D, to be closed without any assistance of the cover unit 50. The double-sided guide unit 30 is pushed by the pushing plate 55 of the cover unit 50, so that the double-sided guide unit 30 is rotated up at an angle at which the double-sided guide unit 30 is started to be moved to the closure position by its self weight.

When the double-sided guide unit 30 is rotated by its self weight, the double-sided guide unit 30 and the pushing plate 55 of the cover unit 50 are separated from each other, so that the cover unit 50 is first turned to a closure position at which the tip of the positioning pin 42 is properly inserted into the pin hole 52 whereas the double-sided guide unit 30 stands by at the closure position. In this manner, the positioning pin 42 can be excellently fitted into the pin hole 52. To the contrary, in the case where the engagement relationship between the positioning pin 42 and the pushing plate 55 is kept without any release, the tip of the positioning pin 42 may not be excellently fitted into the pin hole 52 due to hooking of the positioning pin 42 on the projection of the pin hole 52. Although the description has been given of the embodiment in which the double-sided guide unit 30 and the pushing plate 55 of the cover unit 50 are once separated from each other, the following configuration may be available. When the pushing plate may be constituted of a flexible member, the cover unit 50 may be turned to a closure position such that the tip of the positioning pin 42 is properly inserted into the pin hole 52 while keeping the pushing plate and the cover unit 50 in a contact state.

Figure 11B:
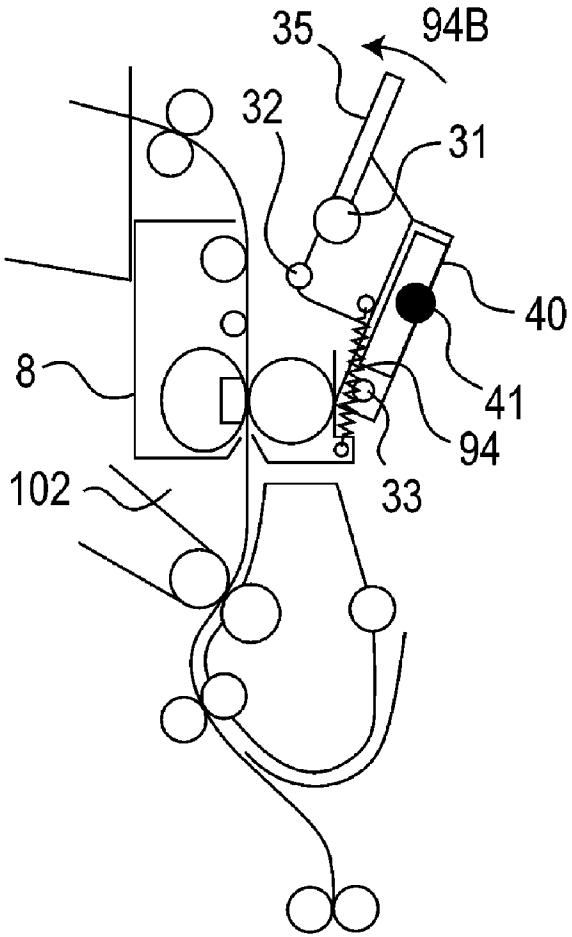
FIGS. 11A and 11B are cross-sectional views illustrating modifications according to the present invention.
Figure 11A:
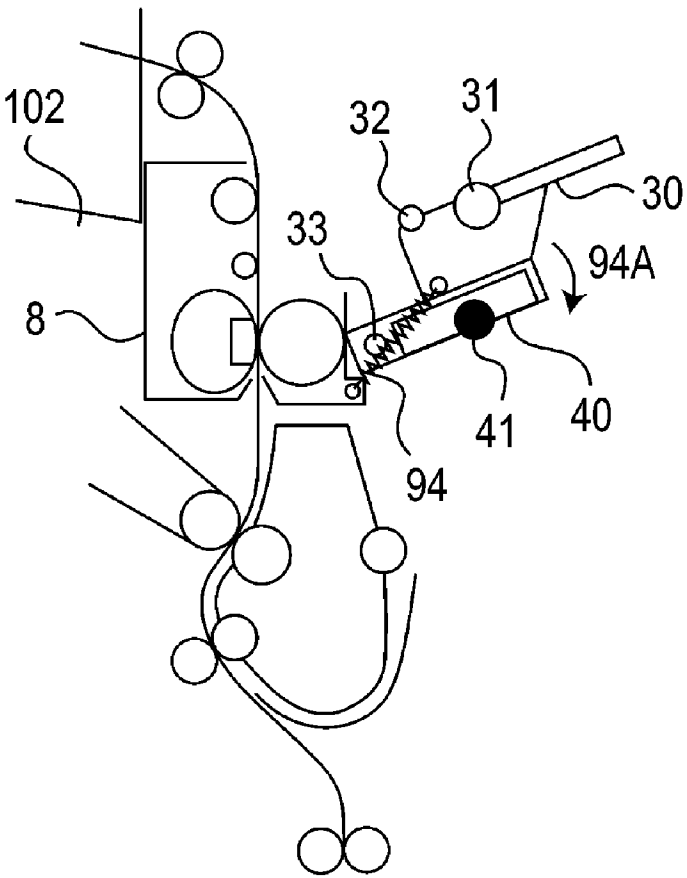

Although the double-sided guide unit 30 is rotated to the closure position by its self weight after the double-sided guide unit 30 is pushed by the pushing plate 55 of the cover unit 50 in the embodiment, the double-sided guide unit 30 may be rotated to the closure position by the biasing force of the spring after the double-sided guide unit 30 is pushed by the pushing plate 55 of the cover unit 50. FIGS. 11A and 11B illustrate a mode in which the double-sided guide unit 30 is moved to the closure position by the biasing force of the spring. A tension spring 94 serves as a biasing member which is fixed at one end thereof to the apparatus body whereas at the other end thereof to the double-sided guide unit 30. As illustrated in FIG. 11A, when the double-sided guide unit 30 is open, a biasing force 94A of the tension spring 94 acts on the double-sided guide unit 30 in such a manner as to open the double-sided guide unit 30. In contrast, when the double-sided guide unit 30 is open at a small angle, the biasing force 94B of the tension spring 94 acts on the double-sided guide unit 30 in such a manner as to close the double-sided guide unit 30, as illustrated in FIG. 11B. The pushing plate 55 of the cover unit 50 pushes the double-sided guide unit 30 up to an angle at which the biasing force of the tension spring 94 acts on the double-sided guide unit 30 in such a manner as to close the double-sided guide unit 30. Incidentally, when a biasing force of a tension spring 94 acts in such a manner as to rotate the double-sided guide unit 30 to the closure position, the double-sided guide unit 30 and the pushing plate 55 of the cover unit 50 are separated from each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-267212, filed Oct. 16, 2008, which is hereby incorporated by reference herein in its entirety.

What is claimed is:

1. A sheet conveying apparatus comprising:

an apparatus body;

a guide unit which is rotatably supported by the apparatus body in such a manner as to be rotatable between a closure position and an open position and forms a first conveyance path, on which a sheet is conveyed, in cooperation with the apparatus body;

a cover which is rotatably supported by the apparatus body and forms a second conveyance path, on which the sheet is conveyed, in cooperation with the guide unit, the cover having a rotation center at a different position from a rotation center of the guide unit;

a first conveying portion which is disposed on the cover and conveys the sheet on the second conveyance path;

a second conveying portion which is disposed on the guide unit in such a manner as to be movable relatively to the guide unit and conveys the sheet on the second conveyance path with the first conveying portion;

a positioning pin provided on one of the second conveying portion or the cover;

a positioning hole which is provided on the other of the second conveying portion or the cover and which engages with the positioning pin when the guide unit is at the closure position, wherein the second conveying portion is positioned by engaging the positioning pin and the positioning hole with respect to the first conveying portion on the cover;

a holding portion which is disposed in the apparatus body and holds the guide unit at a holding position where the guide unit is held in the open position, wherein the positioning pin and the positioning hole do not engage with each other when the holding portion holds the guide unit at the holding position; and a pushing portion which is provided on the cover to push the guide unit that is held at the holding position by the holding portion to cause the guide unit to move from the holding position toward the closure position by an operation of closing the cover so that the guide unit which has been pushed by the pushing portion moves to the closure position by a self weight of the guide unit or a biasing force of a biasing member, wherein as the guide unit is located at the closure position the positioning pin and the positioning hole engage with each other by the operation of closing the cover.

2. The sheet conveying apparatus according to claim 1, wherein the pushing portion and the guide unit are separated from each other to move the guide unit to the closure position by pushing the guide unit during the operation for closing the cover, and then, the positioning pin and the positioning hole start to engage with each other by an operation for further closing the cover in the separation of the pushing portion from the guide unit.

3. The sheet conveying apparatus according to claim 1, further comprising:

a first roller disposed in the first conveying portion; and a second roller disposed in the second conveying portion so as to convey the sheet while nipping the sheet with the first roller, wherein the second conveying portion is mounted on the guide unit in such a manner as to be movably inclined within a plane of the second conveyance path; and the second conveying portion is positioned by engaging the positioning pin and the positioning hole in such a manner that the rotary axes of the first roller and the second roller become parallel to each other at a time when the positioning pin and the positioning hole engage with each other.

4. The sheet conveying apparatus according to claim 1, wherein the guide unit held at the holding position by the holding portion and the pushing portion of the cover to be turned abut against each other, and further, the guide unit is pushed by the pushing portion when the cover is closed, to be then rotated toward the closure position.

5. The sheet conveying apparatus according to claim 2, wherein the guide unit is rotated to the closure position by the self weight of the guide unit or the biasing force of the biasing member during the operation of closing the cover so that the pushing portion and the guide unit are separated from each other during the operation of closing the cover.

6. The sheet conveying apparatus according to claim 5, wherein the positioning pin and the positioning hole start to engaging with each other in the separation of the pushing portion from the guide unit.

7. An image forming apparatus comprising:

an apparatus body;

a guide unit which is rotatably supported by the apparatus body in such a manner as to be rotatable between a closure position and an open position and forms a first conveyance path, on which a sheet is conveyed, in cooperation with the apparatus body;

a transferring portion which transfers an image onto a sheet conveyed on the first conveyance path;

a fixing device which fixes, to the sheet, the image transferred onto the sheet by the transferring portion;

a cover which is rotatably supported by the apparatus body and forms a second conveyance path, on which the sheet is conveyed, in cooperation with the guide unit, the cover having a rotation center at a different position from a rotation center of the guide unit;

a first conveying portion which is disposed on the cover and conveys the sheet on the second conveyance path;

a second conveying portion which is disposed on the guide unit in such a manner as to be movable relatively to the guide unit and conveys the sheet on the second conveyance path with the first conveying portion;

a positioning pin provided on one of the second conveying portion or the cover;

a positioning hole which is provided on the other of the second conveying portion or the cover and which engages with the positioning pin when the guide unit is at the closure position, wherein the second conveying portion is positioned by engaging the positioning pin and the positioning hole with respect to the first conveying portion on the cover;

a holding portion which is disposed in the apparatus body and holds the guide unit at a holding position where the guide unit is held in the open position, wherein the positioning pin and the positioning hole do not engage with each other when the holding portion holds the guide unit at the holding position; and a pushing portion which is provided on the cover to push the guide unit that is held at the holding position by the holding portion to cause the guide unit to move from the holding position toward the closure position by the operation of closing the cover so that the guide unit which has been pushed by the pushing portion moves to the closure position by a self weight of the guide unit or a biasing force of a biasing member, wherein as the guide unit is located at the closure position the positioning pin and the positioning hole engage with each other by the operation for closing the cover.

8. The image forming apparatus according to claim 7, further comprising:

a discharge roller which discharges the sheet having the image fixed thereto by the fixing device;

wherein the first conveyance path is a path on which the sheet is guided from the fixing device toward the discharge roller; and the second conveyance path is a path on which the sheet switched back through the first conveyance path is guided again to the transferring portion.

9. The image forming apparatus according to claim 7, wherein the pushing portion and the guide unit are separated from each other to move the guide unit to the closure position by pushing the guide unit during the operation for closing the cover, and then, the positioning pin and the positioning hole start to engage with each other by an operation for further closing the cover in the separation of the pushing portion from the guide unit.

10. The image forming apparatus according to claim 7, further comprising:

a first roller disposed in the first conveying portion; and a second roller disposed in the second conveying portion so as to convey the sheet while nipping the sheet with the first roller, wherein the second conveying portion is mounted on the guide unit in such a manner as to be movably inclined within a plane of the second conveyance path; and the second conveying portion is positioned by engaging the positioning pin and the positioning hole in such a manner that the rotary axes of the first roller and the second roller become parallel to each other at a time when the positioning pin and the positioning hole engage with each other.

11. The image forming apparatus according to claim 9, wherein the guide unit is rotated to the closure position by the self weight of the guide unit or the biasing force of the biasing member during the operation of closing the cover so that the pushing portion and the guide unit are separated from each other during the operation for closing the cover.

12. The image forming apparatus according to claim 11, wherein the positioning pin and the positioning hole start to engaging with each other in the separation of the pushing portion from the guide unit.

13. The image forming apparatus according to claim 1, wherein the second conveying portion is positioned by engaging the positioning pin and the positioning hole which move relative to each other within a plane of the second conveyance path.

14. The image forming apparatus according to claim 7, wherein the second conveying portion is positioned by engaging the positioning pin and the positioning hole which move relative to each other within a plane of the second conveyance path.

* * * * *